United States Patent [19]

Ando et al.

[11] 4,001,014

[45] Jan. 4, 1977

[54] ELECTROPHOTOGRAPHIC PHOTOSENSITIVE PLATE HAVING TELLURIUM PRESENT IN VARYING CONCENTRATIONS ACROSS ITS THICKNESS

[75] Inventors: Eiji Ando, Katano; Yoshiki Hayashi, Hirakata, both of Japan

[73] Assignee: Matsushita Electric Industrial Co., Ltd., Japan

[22] Filed: Sept. 12, 1974

[21] Appl. No.: 505,497

[30] Foreign Application Priority Data

Sept. 17, 1973 Japan ..... 48-105269
Oct. 19, 1973 Japan ..... 48-118200

[52] U.S. Cl. ..... 96/1.5; 252/501
[51] Int. Cl.[2] ..... G03G 5/04
[58] Field of Search ..... 96/1.5; 252/501

[56] References Cited

UNITED STATES PATENTS

| | | | |
|---|---|---|---|
| 2,803,541 | 8/1957 | Paris | 96/1.5 |
| 3,041,166 | 6/1962 | Bardeen | 96/1.5 |
| 3,350,595 | 10/1967 | Kramer | 96/1.5 |
| 3,355,289 | 11/1967 | Hall et al. | 96/1.5 |
| 3,708,291 | 1/1973 | Kinoshita et al. | 96/1.5 |
| 3,723,105 | 3/1973 | Kitajima et al. | 96/1.5 |
| 3,725,058 | 4/1973 | Hayashi et al. | 96/1.5 |
| 3,771,866 | 11/1973 | Ogawa | 96/1.5 |
| 3,787,207 | 1/1974 | Hasegawa et al. | 96/1.5 |
| 3,861,913 | 1/1975 | Chiou | 96/1.5 |
| 3,881,923 | 5/1975 | Tanaka et al. | 96/1.5 |
| 3,904,408 | 9/1975 | Hanada et al. | 96/1.5 |

*Primary Examiner*—David Klein
*Assistant Examiner*—Judson R. Hightower
*Attorney, Agent, or Firm*—Wenderoth, Lind & Ponack

[57] ABSTRACT

An electrophotographic photosensitive plate having, in order from the bottom up, an electrically conductive substrate, a photosensitizing layer composed of vitreous selenium and tellurium having a thickness of 0.1 to 3 microns, and a top organic layer including polyvinyl carbazole or a derivative thereof, the photosensitizing layer being composed of a first layer of 0.05 to 2 microns in thickness having 60 to 90 weight % of selenium and 40 to 10 weight % of tellurium and a second layer of 0.05 to 1 micron in thickness having a higher concentration of selenium than that of the first layer, and the second layer being positioned between the first layer and the top organic layer. This invention also provides a process of producing a latent electrostatic image on the plate by providing a negative electrostatic charge thereon and exposing the plate to a light image of visible light having a wavelength in the range of 4000 to 8000A. Advantages of this electrophotographic plate are that it has high sensitivity to the visible light along with low residual potential.

14 Claims, 1 Drawing Figure

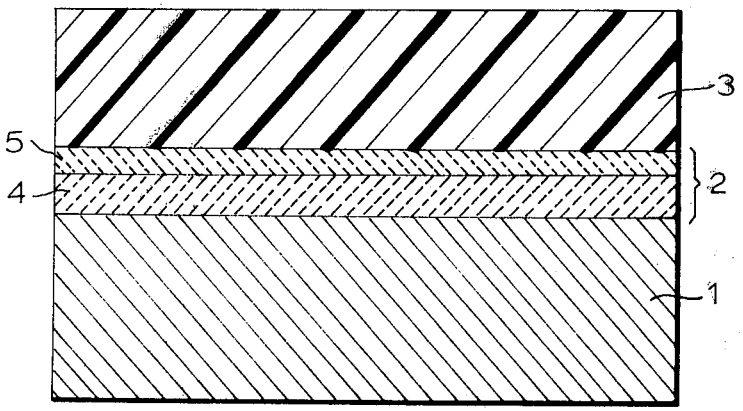
3
5
4
2
1

ELECTROPHOTOGRAPHIC PHOTOSENSITIVE PLATE HAVING TELLURIUM PRESENT IN VARYING CONCENTRATIONS ACROSS ITS THICKNESS

BACKGROUND OF THE INVENTION

This invention relates to an electrophotographic photosensitive plate, and more particularly to an improved multi-layered electrophotographic photosensitive plate comprising a photosensitizing layer of vitreous selenium and tellurium and a charge-retaining and charge-transporting top layer of an organic material.

It is known that images may be formed and developed on the surface of certain photoconductive insulating materials by electrostatic means. The basic electrophotographic process, as taught by Carlson in U.S. Pat. No. 2,297,691, involves uniformly charging a photoconductive insulating layer and then exposing the layer to a light-and-shadow image which dissipates the charge on the areas of the layer which are exposed to light. The electrostatic latent image formed on the layer corresponds to the configuration of the light-and-shadow image. This image is rendered visible by depositing on the image layer a finely divided developing material comprising an electroscopic marking material called a toner. This powder developing material will normally be attracted to those portions of the layer which retain a charge, thereby forming a powder image corresponding to the latent electrostatic image. This powder image may be transferred to paper or other receiving surfaces. The paper then will bear the powder image which may subsequently be made permanent by heating or other suitable fixing means. The above general process, the so called Carlson process, is also described in U.S. Pat. Nos. 2,357,809, 2,891,011 and 3,079,342.

In the electrophotographic process, it is desired that the electrophotographic photosensitive plate can be highly charge-retaining when subjected to the charging, that the charge retained on the plate can be quickly discharged to an electrically conductive substrate when the plate is exposed to a visible light be high with respect to a wide range of wavelengths of light (i.e. that it be is high with respect to wide wavelength range of the light (which panchromatic), and that the residual potential (charge) on the plate after the light exposure be low. For using the plate in a roll form or a bent form, it is desired that the plate be flexible.

French Pat. No. 72/36769 discloses an electrophotographic photosensitive plate comprising, in order from the bottom up, an electrically conducting substrate, a photosensitizing layer of vitreous selenium-tellurium alloy, an organic top layer comprising a member selected from the group consisting of polyvinyl carbazole and a derivative thereof. This known electrophotographic plate is advantageously flexible, panchromatic and highly charge-retaining. Further, this known plate can be either highly sensitive to visible light (one advantage) or the plate can have low residual potential (one advantage). However, this known plate cannot have both of these advantages at the same time.

Accordingly, it is an object of this invention to provide an electrophotographic plate having all the advantages of the known electrophotographic plate, high sensitivity to visible light and low residual potential at the same time.

This object is achieved by making the photosensitizing layer comprising selenium and tellurium have a two-part structure composed of a first layer part 0.05 to 2 microns in thickness having 60 to 90 weight % of tellurium and a second layer part 0.05 to 1 micron in thickness having a higher concentration of selenium than that of the first layer part the second layer part being positioned between the first layer part of the photosensitizing layer and the top organic layer. This second layer part of the photosensitizing layer can also be composed of selenium alone.

This and other objects and features of this invention will become apparent upon consideration of the following detailed description taken together with the accompanying drawing, wherein:

The single FIGURE is a schematic cross-sectional view of an electrophotographic photosensitive plate according to this invention.

DESCRIPTION OF THE PREFERRED EMBODIMENT

Referring to the single FIGURE, an electrophotographic photosensitive plate according to this invention comprises, in order from the bottom up, an electrically conducting substrate 1, a thin photosensitizing layer 2 composed of vitreous selenium and tellurium having a thickness preferably of 0.1 to 3 microns, and a layer 3 of an organic material including polyvinyl carbazole of a derivative thereof. The photosensitizing layer 2 is composed of a first layer part 4 of vitreous selenium-tellurium alloy having a thickness preferably of 0.05 to 2 microns, and a second layer part 5 of vitreous selenium only or vitreous selenium-tellurium alloy having a concentration of selenium higher than that of the first layer and a thickness preferably of 0.05 to 1 micron. The plate is made by vacuum-depositing the thin photosensitizing layer 2 on the electrically conducting substrate 1, and overcoating a solution of an organic material including polyvinyl carbazole or a derivative thereof on the layer 2, and then drying the solvent of the solution so as to form the top layer 3.

The polyvinyl carbazole or derivative thereof (hereinafter for convenience called simply "polyvinyl carbazole") referred to herein is a polymer of vinyl carbazole and/or a derivative thereof, of a copolymer of N-vinyl carbazole or derivative thereof, and another vinyl compound, such as vinyl acetate or methyl methacrylate. The derivative referred to herein has a substitutent, such as a halogen atom, nitro radical, alkyl radical, aryl radical, alkyl aryl radical, amino radical or alkylamino radical, in place of a hydrogen atom in the carbazole ring in the recurring unit of the above mentioned polymers, as shown in the following chemical formula:

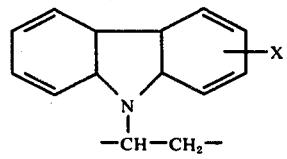

wherein X is the substituent. The number and position of said substitutents in the carbazole ring and the degree of polymerization of the resultant polymer are determined by their method of preparation and are not limited to those expressly disclosed herein.

It is known that polyvinylcarbazole can be applied to a conductive substrate to form a film layer having a dry thickness of about 0.5–50$\mu$, which is utilized as an electrophotographic photosensitive material. It is also known that such a layer of polyvinyl carbazole is inherently photosensitive to light in the near ultraviolet region (about 300–450$\mu$) and can be extended to be photosensitive in the visible ray region by adding an active additive such as Lewis acid and/or a sensitizing dye to a coating solution of polyvinyl carbazole, as described in the U.S. Pat. No. 3,037,861.

In the case of the electrographic photosensitive plate of the present invention, however, the addition of a sensitizer into the top layer 3 of the polyvinyl carbazole is not necessary, and, on the contrary, seems undesirable because charge retentivity and light decay speed are somewhat reduced by the sensitizer. The reason for this is not yet completely clear, but it is considered to be partly due to the fact that a sensitizer molecule dispersed in the layer 3 of polyvinyl carbazole acts as a filter which attenuates the intensity of actinic light which reaches the photosensitizing layer 2 of vitreous selenium and tellurium through the layer 3, and acts as a trap which traps the moving carrier in the layer 3 of polyvinyl carbazole.

In order to improve the characteristics of the polyvinyl carbazole layer 3, such as charge-retentivity, dielectric strength, flexibility, mechanical strength and resistance to mechanical wear, some additives such as plasticizers and binders may be selectively added to the polyvinyl carbazole. Known plasticizers are, for example, chlorinated diphenyl, epoxy resin, dioctyl phthalate, tricresyl phosphate, etc. Known binders are, for example, polycarbonate, cyanoethyl cellulose, etc.

When the layer 3 is improved by such additives described above, the operable thickness of the polyvinyl carbazole layer 3 can be reduced to less than about 40$\mu$. The most preferable thickness for practical use is from 10 to 25$\mu$. The layer 3 thus prepared enhances the low charge-retentivity of the thin layer 2 of selenium and tellurium and provides a normal charge-retentivity. Further, by placing the layer 3 on the layer 2, there is practically no need to place an electrical barrier layer between the electrically conducting substrate 1 and the layer 2, such as is preferably used in a conventional xerographic tellurium-doped selenium plate, as described in U.S. Pat. No. 2,962,376.

With regard to the electrically conducting substrate 1 of the single FIGURE, any available and suitable conducting base may be used, for example, a flexible material such as a paper or a plastic sheet of polyester, cellulose acetate, etc., having a thin layer of aluminium, copper iodide, etc. thereon. The flexible substrate may be in any form such as a sheet or web. On the other hand, for an application where flexibility and transparency are not required, any rigid and suitable base may be used in any convenient thickness and in any desired form such as a plate, cylinder, drum, etc.

The layer 2 of selenium and tellurium is made as follows. First, the layer part 4 of the layer 2 is made by vacuum evaporating and depositing selenium-tellurium alloy on the conducting substrate 1 from one source (by a so-called alloy evaporation method) or by evaporating selenium and tellurium simultaneously from different sources (by a so-called co-evaporation method) followed by depositing. It is also possible to use a flash evaporation method. The selenium (or tellurium) concentration of this layer part 4 is substantially uniform. The layer part 5 on the layer part 4 is made by vacuum evaporating and depositing on the layer part 4 (1) selenium-tellurium alloy having a selenium concentration higher than that used in making the layer part 4 or (2) selenium alone, in the same manner as that used in making the layer part 4.

Or alternatively, the layer part 2 is made e.g. as follows. The layer 1 is subjected to vacuum evaporation and depositing of selenium-tellurium alloy from a first source for a suitable time. Before stopping the vacuum evaporation from that first source, (1) selenium-tellurium alloy having a selenium concentration higher than that in the first source or (2) selenium alone is gradually heated up as a second source. And at a suitable time thereafter, the heat for the first source is gradually stopped. After the stopping of the heat (evaporation) of the first source, the heat (evaporation) of the second source is continued for a suitable time. By using this process, a two-layer structure (layer parts 4 and 5) can be obtained. In this case, the vacuum evaporated layer part made by the first source by the time the heat-up of the second source is started is the layer part 4, and the layer part made on the layer part 4 thereafter is the layer part 5. Thus, the layer part 4 has a substantially uniform concentration of selenium (or tellurium), and the layer part 5 has a concentration of selenium gradually increasing from the lowest concentration at the surface thereof facing the layer part 4 to the highest concentration at the surface thereof facing the top layer.

In the electrophotographic plate according to this invention, the thickness of the layer 2 is preferably less than 3 microns in order to promote flexibility and easy manufacturing. In the case of the electrophotographic plate of the invention, the time required for evaporation deposition is less than one minute, and in practice is only a few seconds. Further, because of the small thickness of the layer of selenium-tellurium alloy, the resultant plate has a low manufacturing cost and has excellent flexibility. From the view point of the sensitizing function of layer 2, the thickness of the layer part 4 is preferably more than 0.05 micron, more preferably more than 0.3 micron, and the thickness of the layer part 5 is preferably less than 1 micron, and more preferably less than 0.3 micron. To obtain a good residual potential of the resultant electrophotographic plate, the thickness of the layer part 5 is preferably more than 0.5 micron, and more preferably more than 0.1 micron.

The tellurium concentration in the layer part 4 is preferably less than 40 weight %, and more preferably less than 25 weight %, to obtain good electrophotographic characteristics of the resultant plate such as a good charge-retaining property and ease of manufacturing of the electrophotographic plate. Further, it is preferably more than 10 weight %, and more preferably more than 15 weight %, to obtain a good sensitizing function of the layer 2. Therefore, the preferable weight % range of selenium in the layer part 4 is 90 to 60, and a more preferable one is 85 to 75. The selenium concentration in the layer part 5 should be more than that in the layer part 4 and the tellurium concentration less for obtaining the effect of using the two-layer structure, i.e. layer parts 4 and 5, (i.e. the addition of layer part 5 to layer part 4). with respect to residual potential of the resultant electrophotographic plate. More preferably, the difference between the concentration of selenium in weight % in the layer part 4 and that in the layer part 5 is more than 10. In the case when the selenium concentration in the layer part 4 is less than 90 weight %, and the tellurium concentration is more than 10 wt.% the selenium concentration in the layer part 5 is preferably more than 90 weight % and the tellurium concentration is less than 10 wt.% to obtain good residual potential. The layer part 5 can be composed of vitreous selenium only. Furthermore, because the plate of the invention easily forms a negatively charged latent image having a surface potential of about 1000 volts or more and holds it for a long time, it is possible to use the plate not only in the common xerographic process including a step of applying charged powder directly to the plate, but also in a method called TESI (transferring an electrostatic image) of transferring the electrostatic latent image to a dielectric coated paper. The electrophotographic plate of the invention has an increasing rate of charge potential similar to that of a conventional xerographic plate of an Electrofax paper under the usual negative corona discharge atmosphere in the dark.

As described hereinbefore, the electrophotographic plate of this invention has a layer 3 of organic material having a thickness of about 10 to 40 microns applied on photosensitizing layer 2. So this electrophotographic plate has high charge retentivity. The electrophotographic plate of the invention does not require an electric barrier layer such as a thin layer of polypyromellitic imide, epoxy resin or porous aluminium oxide. Further, the electrophotographic plate of this invention is panchromatic over the wavelength of visible light of 4000 to 8000A.

EXAMPLE 1

Selenium-tellurium alloy was vacuum-evaporated at a vacuum of $5\times10^{-5}$ Torr and deposited to form a thin selenium-tellurium layer having a thickness of 0.3 micron on an electrically conducting substrate comprising polyester film 75 microns in thickness and an aluminium layer 1 micron in thickness. The amount of tellurium in the selenium-tellurium layer for six pairs of specimens was varied so as to be 10, 15, 20, 25, 30 and 40 weight %, respectively. Thus, two groups each having six specimens (10, 15, 20, 25, 30 and 40 weight % tellurium, respectively) were made. On one group of six specimens, vitreous selenium only was vacuum-evaporated and deposited $5\times10^{-5}$ Torr to form a selenium layer of 0.2 micron on each specimen. Completed electrophotographic plates made from the respective six specimens were designated as Sample No. 1 (10 weight % Te) to Sample No. 6 (40 weight % Te), respectively. Completed electrophotographic plates made from the other group of six specimens were designated as Sample No. 7 (10 weight % Te) to sample No. 12 (40 weight % Te), respectively. The thickness and the composition ratio of the selenium-tellurium layer was determined by photoelectric colorimetry by using, as a coloring reagent, 3, 3'-diaminobenzidine tetrahydrochloride for selenium and potassium iodide for tellurium.

A solution consisting of 100g of poly-N-vinylcarbazole, 30 g of polycarbonate (Panlite L 1250, Teijin Co., Tokyo, Japan), 20g of diphenyl chloride (kanechlor No. 400, Kanegafuchi-Kagaku Co., Osaka, Japan), 20 g of xyrenic resin (Nikanol, Nippon Gas-Kagaku Co., Tokyo, Japan), 10g of diphenylmethane-4,4'-diisocyanate (Millionate MR, Nippon-Polyurethane Co., Tokyo, Japan), 900g of monochlorobenzene and 300g of dichloroethane was prepared and applied on the 12 samples with the respective selenium layers and selenium-tellurium alloy layers thereon. The thickness of each of the dried coatings was 15 microns.

The completed 12 plates No. 1 to No. 12 were then tested with an electrophotographic photosensitometer with a conventional dynamic decay tester. Further, the 12 plates were subjected to tests for measuring their spectral responses in the visible light region with the aid of an electrophotographic grating spectrograph.

All the Samples Nos. 1–12 could be charged with −1000 volts. To check the sensitivity of each Sample to light, $E_{50}$ of each Sample was measured, wherein $E_{50}$ is the light exposure in lux.sec required for causing each Sample to have a surface potential of half of the initial surface potential thereof before the start of light exposure. Further, the surface potential of each Sample after a light exposure of 30 lux.sec was taken as the residual potential of each Sample.

$E_{50}$ of Samples Nos. 1–12 were 6, 3.3, 2.1, 1.9, 1.7, 1.1, 6, 3.1, 2.0, 1.8, 1.5 and 0.9 lux.sec, respectively. This indicates that there was substantially no difference in $E_{50}$ between the Samples including the same amount of tellurium in the selenium-tellurium layer.

The residual potentials of Samples Nos. 1–12 were 7, 7,7, 10, 20, 25, 30, 40, 50, 60, 75 and 100 volts, respectively. This indicates that there was a great difference in residual potential between the Samples including the same amount of tellurium in the selenium-tellurium layer.

It was further found that there was substantially no difference in the wavelength range of light to which the Samples were sensitive, between the Samples including the same amount of tellurium in the selenium-tellurium layer. For example, Samples Nos. 3 and 9 both had a wavelength range of 4000 to 8000A to which they were sensitive. That is, they had the same panchromatic photosensitivity.

Upon subjecting the Samples to conventional copying process of charging, light exposure, transfer and development, it was found that Samples Nos. 1–6 were reusuable for more than several thousand times, and were superior in reusability to Samples Nos. 7–12, respectively.

EXAMPLE 2

In a manner similar to that of making Sample No. 3 in EXAMPLE 1, Samples Nos. 13–16 were made which were the same as Sample No. 3 except that the selenium-tellurium alloy layers of these Samples Nos. 13–16 were 0.01 micron, 0.05 micron, 0.5 micron and 2 microns thick, respectively. These Samples were charged with −1000 volts, and $E_{50}$ was measured for each. Sample No. 13 had $E_{50}$ of 8 lux.sec, Sample No. 14 had $E_{50}$ of 2.5 lux.sec, and Samples Nos. 15 and 16 had $E_{50}$ of 2 lux.sec. Sample No. 13 was therefore much less sensitive to light than the other samples.

EXAMPLE 3

In a manner similar to that of making Sample No. 3 in EXAMPLE 1, Samples Nos. 17–22 were made which were the same as Sample No. 3 except that each of these Samples Nos. 17–22 had a selenium-tellurium alloy layer 0.2 micron thick instead of the layer of selenium only in Sample No. 3. That is, this selenium-tellurium alloy layer of each of Samples Nos. 17–22 was on the selenium-tellurium alloy layer of 0.3 micron thick firstly made on the electrically conducting substrate thereof. This selenium-tellurium alloy layer of 0.2 micron thick, instead of the layer of selenium only of Sample No. 3, was made by the same vacuum-evaporation technique described in EXAMPLE 1. These selenium-tellurium alloy layers of 0.2 micron thick of these Samples Nos. 17–22 had tellurium concentrations of 3, 7, 10, 15, 20 and 30 weight %, respectively. These Samples were charged with −1000 volts, and $E_{50}$ and the residual potential of each were measured. Samples Nos. 17–21 had $E_{50}$ of 2 lux.sec, and Sample No. 22 had $E_{50}$ of 1.6 lux.sec. Samples Nos. 17–22 had residual potentials of 8, 10, 13, 35, 50 and 80 volts, respectively. This indicates that Sample No. 22 has a little better $E_{50}$ than the other Samples, but was very much inferior in its residual potential. Sample No. 21 was no different in residual potential from Sample No. 9. Sample No. 20 was better, but not very much, in residual potential than Sample No. 21 or 9. On the other hand, Samples Nos. 17–19 were very much superior in residual potential than Sample No. 21 or 9. This further indicates that it is desirable that the amount of tellurium in the selenium-tellurium layer of 0.2 micron be less than 10 weight % (and the amount of selenium be more than 90 weight %).

EXAMPLE 4

In a manner similar to that of making Sample No. 2 in EXAMPLE 1, Samples Nos. 23–28 were made which were the same as Sample No. 2 except that the layers of selenium only of these Samples Nos. 23–28 were 0.01, 0.05, 0.1, 0.5, 1 and 2 microns thick, respectively. $E_{50}$ and residual potentials of these Samples Nos. 23–28 were measured. Samples Nos. 23–25 had $E_{50}$ of 3 lux.sec, Sample No. 26 had $E_{50}$ of 3.2 lux.sec, Sample No. 27 had $E_{50}$ of 4 lux.sec, and Sample No. 28 had $E_{50}$ of 8 lux.sec. Samples Nos. 23–25 had residual potentials of 45, 20 and 10 volts, respectively. And Samples Nos. 26–28 had a residual potential of 7 volts. This indicates that Samples Nos. 23–27 had good $E_{50}$, whereas Sample No. 28 had inferior $E_{50}$. Further, Samples Nos. 24–28 had acceptable residual potentials, whereas Sample No. 23 had a high residual potential.

EXAMPLE 5

Selenium-tellurium alloy (25 weight % Te) was vacuum-evaporated and deposited on an aluminum plate 1 mm thick at $5\times10^{-5}$ Torr from a first source for 5 seconds. Then, vacuum-evaporation of selenium was started from a second source in the same vacuum chamber by gradually heating the second source. Two seconds after the start of the vacuum evaporation by the second source, the heat of the first source was started to be reduced. Four seconds after the start of the vacuum evaporation by the second source, the heat of the first source was reduced sufficiently to stop evaporation. Three seconds after the start of the vacuum evaporation by the second source, the heat of the second source was started to be reduced down. Five seconds after the start of the vacuum evaporation by the second source, the heat of the second source was reduced sufficiently to stop evaporation. Thereby, a two-layer-structured photosensitizing layer was made, which was composed of a first layer part 0.5 micron thick, having a substantially uniform concentration of selenium and tellurium and a second layer part 0.5 micron thick coated on the first layer and having a concentration of selenium gradually increasing from the lowest concentration at the surface thereof facing the first layer part to the highest concentration at the opposite surface thereof. An organic coating 15 microns thick the same as that applied in EXAMPLE 1 was applied on the thus made photosensitizing layer. The thus made electrophotographic plate was designated as Sample No. 29. In the same way, Sample No. 30 was made, except that in making Sample No. 30 selenium-tellurium alloy (5 weight % Te) was used in the second source instead of selenium. Samples Nos. 29 and 30 were subjected to the measurements described in EXAMPLE 1. $E_{50}$ of Samples Nos. 29 and 30 were 1.9 and 1.8 lux.sec, respectively. The residual potentials of Samples Nos. 29 and 30 were 10 and 12 volts, respectively.

EXAMPLE 6

Four Samples each the same as Sample No. 3 except for the organic coating were prepared. For the organic coatings, a solution having a composition similar to that of Example 1 was prepared by replacing poly-N-vinylcarbazole with the same weights of brominated poly-N-vinylcarbazole (for Sample No. 31), iodide poly-N-vinylcarbazole (Sample No. 32), poly-N-vinyl-3-aminocarbazole (Sample No. 33), and poly-N-vinyl-3-nitrocarbazole (Sample No. 34), and was applied to the layer of selenium-tellurium alloy. The thicknesses of the four dried coatings were all 20 microns. Brominated poly-N-vinylcarbazole is disclosed in detail in Japanese Patent Publications 42-19751/1967, 42-21867/1967 and 42-25230/1967. Also, there are disclosed in detail in Japanese Patent Publication 42-82462/1967 iodide poly-N-vinylcarbazole; in 42-9639/1967 poly-N-vinyl-3-aminocarbazole, and in 41-14508/1966 poly-N-vinyl-3-nitrocarbazole, respectively.

The resultant Samples Nos. 31–34 had almost similar panchromatic photosensitivity to sample No. 3 in EXAMPLE 1 using poly-N-vinylcarbazole. The four Samples could be reused more than several thousand times in the same copying process as that of Example 1.

What is claimed is:

1. An electrophotographic photosensitive plate comprising, in order from the bottom up, an electrically conducting substrate, a photosensitizing layer comprising vitreous selenium and tellurium and having a thickness of 0.1 to 3 microns, and a top layer comprising a member selected from the group consisting of polyvinylcarbazole and derivatives thereof, said photosensitizing layer being composed of a first layer part 0.05 to 2 microns in thickness having 60 to 90 weight % of selenium and 40 to 10 weight % of tellurium and a second layer part 0.05 to 1 micron in thickness having a higher concentration of selenium than that of said first layer part, and said second layer part being positioned between said first layer part and said top layer.

2. An electrophotographic plate according to claim 1, wherein said first layer part of said photosensitizing layer comprises 75 to 85 weight % of selenium and 25 to 15 weight % of tellurium.

3. An electrophotographic plate according to claim 1, wherein said second layer part of said photosensitizing layer comprises more than 90 weight % of selenium.

4. An electrophotographic plate according to claim 1, wherein the difference between the concentration of selenium in weight % in said first layer part of said photosensitizing layer and the concentration of selenium in weight % in said second layer part of said photosensitizing layer is more than 10.

5. An electrophotographic plate according to claim 1, wherein said second layer part is composed of selenium only.

6. An electrophotographic plate according to claim 1, wherein said second layer part of said photosensitizing layer has a substantially uniform concentration therein of selenium.

7. An electrophotographic plate according to claim 1, wherein said second layer part of said photosensitizing layer has a concentration of said selenium gradually increasing from the lowest concentration at the surface thereof facing said first layer part of said photosensitizing layer to the highest concentration at the surface thereof facing said top layer.

8. An electrophotographic plate according to claim 1, wherein said top layer consists essentially of poly-N-vinylcarbazole.

9. An electrophotographic plate according to claim 1, wherein said top layer consists essentially of brominated poly-N-vinylcarbazole.

10. An electrophotographic plate according to claim 1, wherein said top layer further contains an additive which is a binder.

11. An electrophotographic plate according to claim 10, wherein said binder is a member selected from the group consisting of polycarbonate and cyano-ethyl cellulose.

12. An electrophotographic plate according to claim 1, wherein said top layer further contains an additive which is a plasticizer.

13. An electrophotographic plate according to claim 12, wherein said plasticizer is a member selected from the group consisting of chlorinated diphenyl, epoxy resin, dioctyl phthalate and tricresyl phosphate.

14. A process for producing a latent electrostatic image of negative charge on an electrophotographic photosensitive plate defined by claim 1, comprising the steps of providing an electrostatic negative charge thereon in the dark and exposing said plate to a light image of visible light having a wavelength in the range between 4000A and 8000A.

* * * * *